US010711789B2

(12) United States Patent
Palomba et al.

(10) Patent No.: US 10,711,789 B2
(45) Date of Patent: Jul. 14, 2020

(54) MOTOR-COMPRESSOR WITH STAGE IMPELLERS INTEGRATED IN THE MOTOR-ROTORS

(71) Applicant: NUOVO PIGNONE SRL, Florence (IT)

(72) Inventors: Sergio Palomba, Florence (IT); Dante Tommaso Rubino, Florence (IT)

(73) Assignee: NUOVO PIGNONE SRL, Florence (IT)

( * ) Notice: Subject to any disclaimer, the term of this patent is extended or adjusted under 35 U.S.C. 154(b) by 258 days.

(21) Appl. No.: 15/038,108

(22) PCT Filed: Nov. 3, 2014

(86) PCT No.: PCT/EP2014/073598
§ 371 (c)(1),
(2) Date: May 20, 2016

(87) PCT Pub. No.: WO2015/074855
PCT Pub. Date: May 28, 2015

(65) Prior Publication Data

US 2016/0290345 A1 Oct. 6, 2016

(30) Foreign Application Priority Data

Nov. 22, 2013 (IT) ..... FI2013A0283

(51) Int. Cl.
*F04D 25/06* (2006.01)
*F04D 17/12* (2006.01)
(Continued)

(52) U.S. Cl.
CPC ..... *F04D 25/0606* (2013.01); *F04D 17/12* (2013.01); *F04D 29/051* (2013.01);
(Continued)

(58) Field of Classification Search
CPC .... F04D 29/286; F04D 29/058; F04D 29/051; F04D 17/12; F04D 17/08; F04D 19/028; F04D 25/066; F04D 29/442
See application file for complete search history.

(56) References Cited

U.S. PATENT DOCUMENTS 2,681,760 A * 6/1954 Lundquist ..... F04D 21/00 415/208.3
5,075,606 A * 12/1991 Lipman ..... H02K 7/14 310/63
(Continued)

FOREIGN PATENT DOCUMENTS

DE 19608602 A1 9/1997
DE 102007044176 A1 3/2009
(Continued)

OTHER PUBLICATIONS

Norris et al., "Levitating Fan Rotor Paves Way to Electric Flight", Flight International, Reed Business Information, vol. No. 168, Issue No. 4994, pp. 22, Jul. 19, 2005.
(Continued)

*Primary Examiner* — Bryan M Lettman
*Assistant Examiner* — Timothy P Solak
(74) *Attorney, Agent, or Firm* — Baker Hughes Patent Organization

(57) ABSTRACT

A shaftless motor-compressor is disclosed, comprising a casing and at least one compressor stage arranged in the casing. Each compressor stage comprises a respective impeller arranged for rotation in the casing around a rotation axis. Each impeller is combined with an embedded electric motor housed in the casing and comprised of a motor stator and a motor rotor. The motor stator of each compressor stage circumferentially surrounds the impeller and the motor rotor,
(Continued)

integral with the impeller. The motor rotor of each stage is arranged inside the respective motor stator.

19 Claims, 3 Drawing Sheets

(51) Int. Cl.
*F04D 29/051* (2006.01)
*F04D 29/058* (2006.01)
*F04D 29/44* (2006.01)
*F04D 29/42* (2006.01)

(52) U.S. Cl.
CPC ..... *F04D 29/058* (2013.01); *F04D 29/4206* (2013.01); *F04D 29/442* (2013.01); *F04D 29/444* (2013.01); *F04D 25/066* (2013.01)

(56) References Cited

U.S. PATENT DOCUMENTS 5,474,429 A * 12/1995 Heidelberg ..... F04D 25/066 310/63
5,547,350 A * 8/1996 Rawal ..... F04D 25/0606 417/354
6,712,588 B1 * 3/2004 Ribaud ..... F01D 9/048 415/224.5
6,896,492 B2 * 5/2005 Masterton ..... F04D 25/066 310/254.1
7,661,271 B1 2/2010 Millsaps, Jr.

FOREIGN PATENT DOCUMENTS

| | | | | |
|---|---|---|---|---|
| GB | 2022703 A | | 12/1979 | |
| RU | 1814702 A3 | | 5/1993 | |
| RU | 34 215 | * | 11/2003 | ..... F04D 17/02 |
| RU | 34215 U1 | | 11/2003 | |
| RU | 2 461 738 C1 | | 9/2012 | |

OTHER PUBLICATIONS

Unofficial English Translation of Italian Search Report and Written Opinion issued in connection with corresponding IT Application No. FI2013A000283 dated Aug. 4, 2014.
International Search Report and Written Opinion issued in connection with corresponding PCT Application No. PCT/EP2014/073598 dated Feb. 10, 2015.
Laco, M.D., et al., Hyper high pressure pump for integratec compressor line, GE co-pending Application No. MI2009A001235, filed on Jul. 10, 2009.
Machine Translation and First Office Action and Search issued in connection with corresponding CN Application No. 201480063761.X dated Jun. 29, 2017.
Office Action issued in connection with corresponding RU Application No. 2016118644 dated May 25, 2018.

* cited by examiner

STATE OF THE ART

MOTOR-COMPRESSOR WITH STAGE IMPELLERS INTEGRATED IN THE MOTOR-ROTORS

BACKGROUND

The subject matter disclosed herein relates to motor-compressors, in particular to centrifugal motor-compressors and more specifically to multi-stage motor-compressors, particularly multi-stage centrifugal motor-compressors.

Motor-compressors are widely used in several industrial applications to boost the pressure of a gas. Motor-compressors usually comprise a casing wherein a rotor shaft is rotatably supported. One or more impellers are mounted on the rotatable shaft for rotation therewith. A gas enters the compressor at an inlet manifold and is delivered through an outlet manifold at a higher pressure. The work required for boosting the pressure of the gas is provided by a prime mover, for example an electric motor, the motor shaft whereof is mechanically connected to the rotor shaft of the compressor. In known arrangements, the electric motor can be arranged outside the casing of the compressor or integrated in one and the same casing which also houses the compressor stages. In multi-stage compressors the motor drives into rotation all the impellers of the motor-compressor.

FIG. 1 illustrates a compressor 100 of the current art, driven by an electric motor arranged outside the casing of the compressor and not shown. The compressor comprises a compressor casing 101 with an inlet manifold 103 and an outlet manifold 105. A rotor shaft 107 is rotatingly supported in the casing 101 between bearings 109 and 111.

The compressor 100 of FIG. 1 is a two-stage centrifugal compressor comprising a first impeller 113 and a second impeller 115 mounted on shaft 107 and rotating therewith in the casing 101. A first diffuser 117 associated to the first impeller 113 and a second diffuser 119 associated with the second impeller 115 are provided in a stationary position in the casing 101 of compressor 100. A bladed return channel 121 returns the gas delivered by the first impeller 113 through diffuser 117 towards the inlet of the second impeller 115. Gas delivered by the second impeller 115 is collected by a volute 123 and finally discharged through the outlet manifold 105.

The return channel 121 as well as the diffuser 117 and the duct 119 are formed in a stationary diaphragm 125, arranged in the casing 101.

The rotor shaft 107 is coupled, for example through a gear box 108, to an electric motor, not shown. Sealing arrangements must be provided on shaft 107 to prevent gas processed by the compressor from escaping the casing 101.

A balancing drum 116 can be mounted on the shaft 107 or formed integrally therewith, in order to at least partly compensate the axial thrust generated by the gas flow being processed on shaft 107.

In order to remove the need for sealing arrangements on the rotor shaft of the compressor and to reduce the footprint of the motor-compressor arrangement, embedded electric motors have been suggested in combination with the compressor stages of the centrifugal compressor.

U.S. Pat. No. 5,547,350 discloses a modular shaftless motor-compressor, wherein each single impeller is driven into rotation by an embedded electric motor, having a motor stator supported on a fixed portion of the casing and surrounding a first, gas inlet chamber coaxial with the impeller. A motor rotor is arranged around the motor stator, rotates integrally with the impeller and surrounds the gas inlet chamber. The motor rotor is also provided with bearings rotatingly supporting the motor rotor and the impeller in the stationary casing. Each module of the shaftless motor-compressor according to this known prior art has an axial extension which exceeds the axial extension of the impeller, since the embedded motor is arranged in front of the impeller and increases the overall axial dimension of the stage. The diffuser is stationarily arranged in the compressor casing and extends from the outlet of the impeller radially outwardly and towards a respective return channel.

SUMMARY OF THE INVENTION

A shaftless motor-compressor comprising a casing and at least one compressor stage arranged in the casing is provided, wherein each stage comprises an embedded electric motor, i.e. an electric motor housed in the compressor casing. In some embodiments the motor-compressor can include a single compressor stage and thus a single impeller. More particularly, however, the motor-compressor is a multi-stage motor-compressor, including a plurality of serially arranged impellers, each provided with its own embedded electric motor. In an embodiment, each embedded electric motor is comprised of a motor stator, stationarily mounted in the casing and at least partly surrounding the impeller of the relevant compressor stage, i.e. arranged at least partly around the impeller. Each embedded electric motor further comprises a motor rotor integral with the impeller and rotating therewith. The diameter of the motor stator of each stage is larger than the diameter of the respective motor rotor and of the respective impeller, so that the impeller and the motor rotor can be positioned at least partly inside the motor stator. A compact design is thus obtained, since each the embedded electric motor can be partly or entirely contained in the axial extension of the respective impeller.

In some embodiments, each impeller comprises a plurality of blades arranged around the rotation axis and forming vanes for a flow of process gas, which extend from leading edges to trailing edges of the blades. The respective motor stator is arranged radially outwardly and at least partly around the blades of the respective impeller.

In one or more embodiments, each compressor stage comprises a diffuser arrangement, which rotates with the impeller and forms an integral part thereof. The diffuser arrangement can be positioned between the blades and the motor rotor of the respective impeller.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 2:
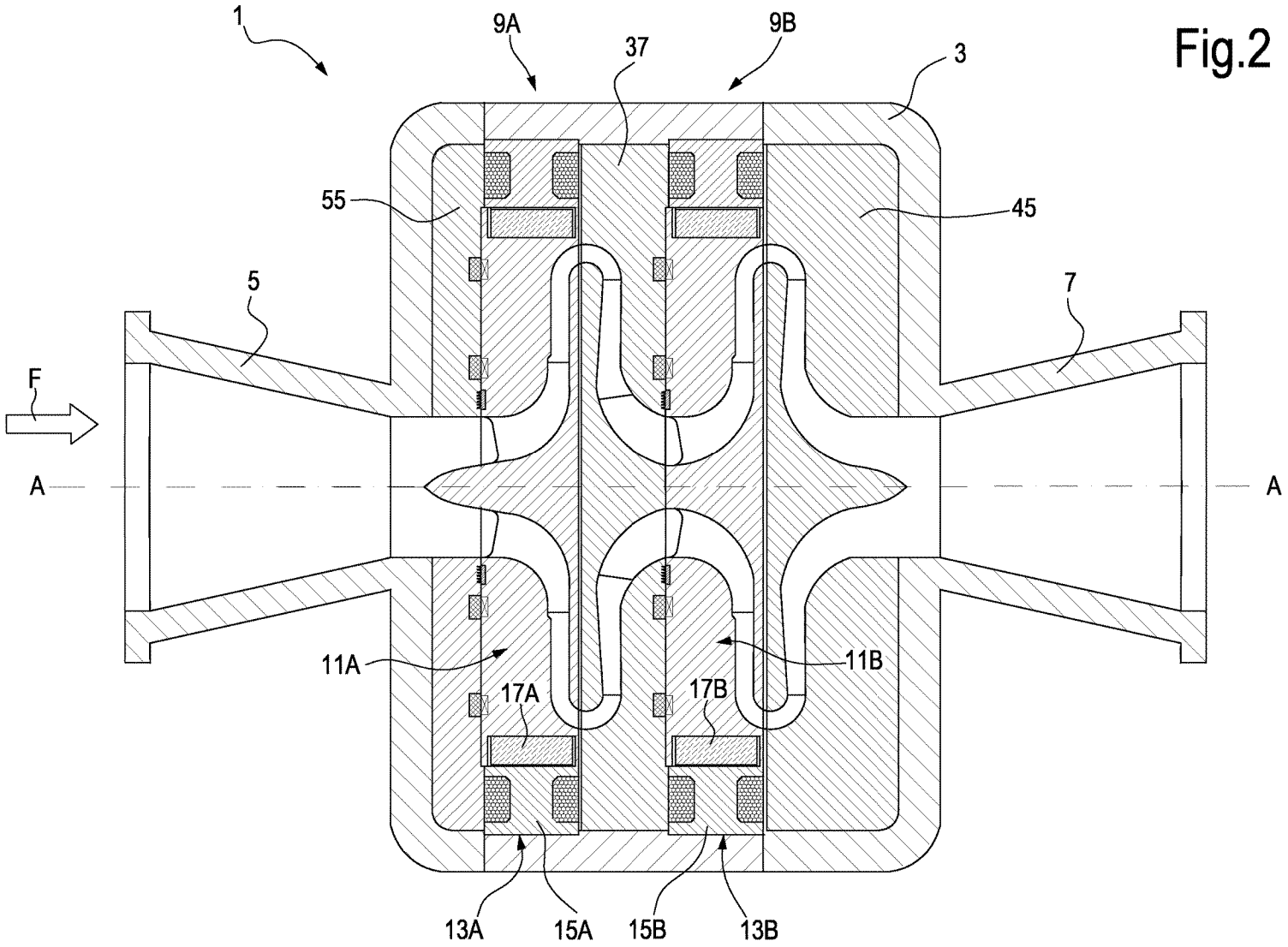
FIG. 2 illustrates a partial section along the rotation axis of an integrated motor-compressor according to the present disclosure.

FIG. 2 shows a section along an axial plane of an integrated motor-compressor 1 according to the present disclosure. The motor-compressor 1 comprises an outer casing 3 with an inlet manifold 5 and an outlet manifold 7. The inlet manifold 5 and the outlet manifold 7 can be aligned along an axis A-A of the motor-compressor 1, which also represents the rotation axis of the compressor impellers, as described below.

In the exemplary embodiment disclosed in the attached drawings the motor-compressor 1 comprises two stages 9A and 9B. This number of stages is by way of example only and it shall be understood that a different number of stages can be provided in the same casing 3 of motor-compressor 1.

Each stage 9A, 9B comprises a respective impeller 11A and 11B, which is supported in casing 3 for rotation around axis A-A The impellers are supported in the casing by bearing arrangements as will be disclosed later on, without the need for a central shaft. The motor-compressor 1 is thus a shaft-less motor-compressor.

Additionally, each stage 9A, 9B comprises an embedded motor 13A, 13B. Each electric motor 13A, 13B is comprised of a motor stator 15A, 15B, which is stationarily arranged in casing 3. Each electric motor 13A, 13B further comprises a motor rotor 17A, 17B. Each motor rotor 17A, 17B is constrained to the respective impeller 11A, 11B rotates integrally therewith and is surrounded by the respective motor stator 13A, 13B.

In some embodiments, each motor stator 15A, 15B comprises a plurality of annularly arranged electromagnets, each comprised of an electric winding 19 wound around a respective ferromagnetic core 21 forming at least one polar expansion facing the respective motor rotor 17A, 17B. In some embodiments, each motor rotor 17A, 17B can be comprised of a plurality of annularly arranged permanent magnets 23 facing the respective motor stator 15A, 15B.

Each impeller 11A, 11B comprises a plurality of blades 29A, 29B arranged around the rotation axis A-A and defining intermediate vanes 31A, 31B, where through the process gas flows while being accelerated by the rotation of the respective impellers. Each blade 29A, 29B extends from a leading edge 29L, arranged at the impeller inlet, to a trailing edge 29T, arranged at the outlet of the vanes 31A, 31B of the relevant impeller.

In some embodiments, each impeller 11A, 11B further comprises a respective diffuser 33A, 33B, arranged peripherally around the outlet of the vanes 31A, 31B.

In some embodiments, the blades 29A, 29B and the respective diffuser 33A, 33B are rotating as a single body around the rotation axis A-A The diffuser 33A, 33B of each impeller 11A, 11B can extend from the outlet of the respective flow vanes 31A, 31B towards the outer periphery of the impeller 11A, 11B, where the respective motor rotor 17A, 17B is arranged.

The diffuser 33A, 33B thus forms an integral part of the relevant impeller and rotates solidly therewith.

Figure 3:
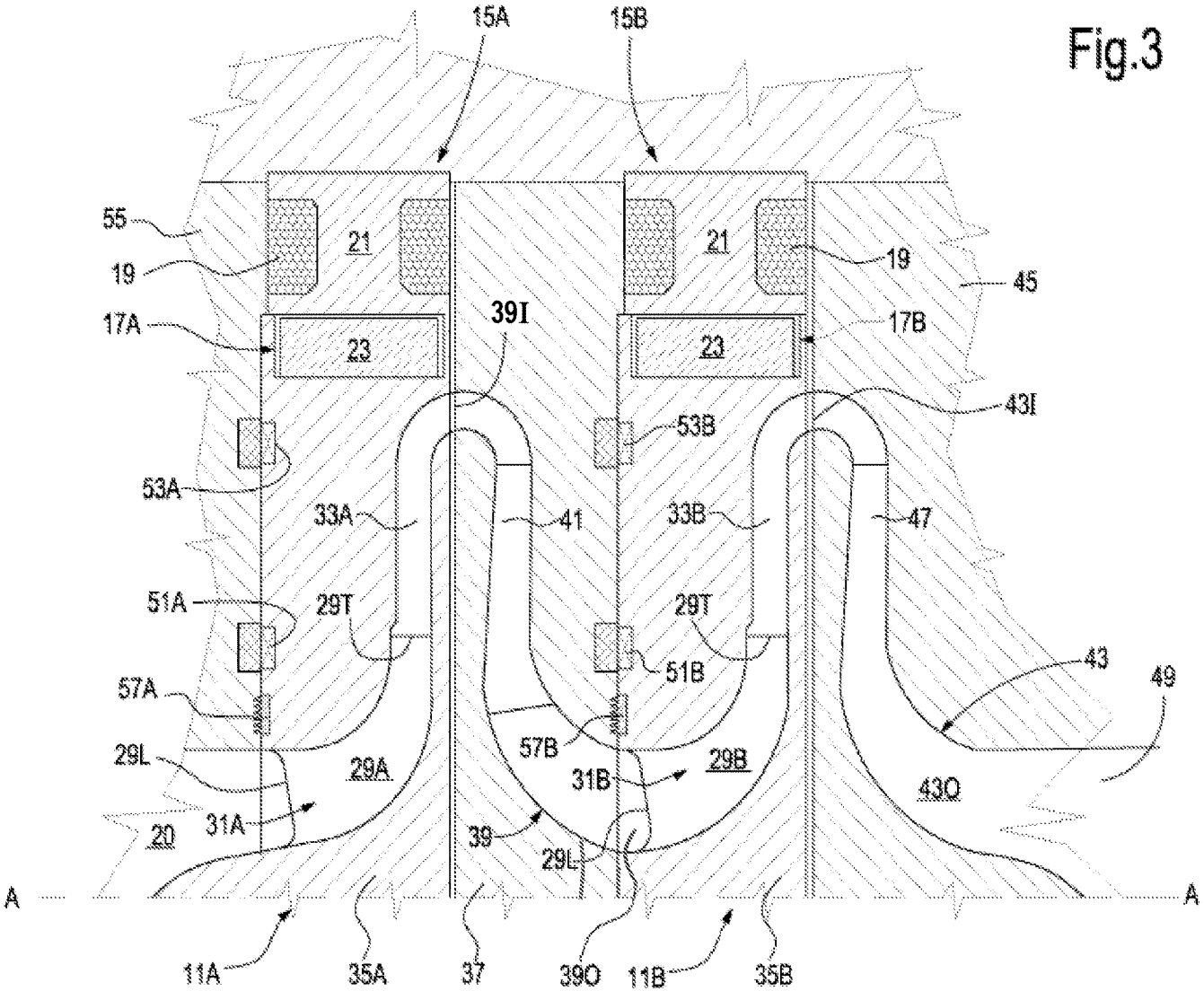
FIG. 3 illustrates an enlargement of a detail of FIG. 2.

In the embodiment shown in FIGS. 2 and 3, therefore, each impeller 11A, 11B comprises a plurality of blades 29A, 29B, the respective diffuser 33A, 33B and the respective motor rotor 17A, 17B. These elements or components of the impeller are arranged sequentially in a radial direction starting from the rotation axis A-A towards the outer periphery of the impeller and rotate integrally as a single unit.

Each impeller 11A, 11B can be designed as a rotary disc 35A, 35B, which can be formed by a single monolithic component, e.g. manufactured by casting. The blades 29A, 29B and the flow vanes 31A, 31B as well as the diffuser 33A, 33B can be generated in the single monolithic disc 35A, 35B, for example by electron-discharge machining, using suitably shaped electrodes. The rotary disc 35A, 35B can thus form the hub and the shroud of the respective impeller 11A, 11B.

The radially outermost region of the disc can house the motor rotor 17A, 17B of the embedded electric motor. In some embodiments, the motor rotor 17A, 17B can be comprised of permanent magnets mounted on the peripheral or circumferential region surrounding the diffuser 33A, 33B and the blades 29A, 29B. The respective motor stator 15A, 15B can be positioned so as circumferentially surrounding the peripheral or circumferential region of the respective disc 35A, 35B.

Differently from the state of the art compressors, therefore, the diffuser rotates integrally with the corresponding blades of the impeller and no sealing must be provided around the impeller eye.

Between the sequentially arranged impellers 11A, 11B an intermediate diaphragm 37 can be arranged. The diaphragm 37 is stationarily mounted in casing 3. A return channel arrangement 39 can be provided in diaphragm 37. In some embodiments the return channel arrangement 39 can be bladed, i.e. provided with stationary blades 41 extending along at least an intermediate portion of the return channel arrangement 39, which in turn extends from a return channel inlet 391, arranged in front of the diffuser outlet, towards a return channel outlet 390, arranged in front of the inlet of the subsequent impeller 11B.

The return channel arrangement 39 collects gas exiting the diffuser 33A of the first impeller 11A and returns the partly compressed gas towards the inlet of the second impeller 11B.

A further return channel arrangement 43 can be provided in a further diaphragm 45 arranged downstream of the second impeller 11B. The second return channel arrangement 43 can in turn be bladed and provided with a set of stationary blades 47 extending along at least an intermediate portion of the second return channel arrangement 43, between a return channel inlet 431 and a return channel outlet 430.

In the exemplary embodiment illustrated in FIGS. 2 and 3 the motor-compressor 1 is comprised of two stages only and therefore the second return channel arrangement 43 does not lead to the inlet of a further impeller, but rather towards an outlet chamber 49, which is in fluid communication with the outlet manifold or delivery manifold 7 of the motor-compressor 1. In some embodiments the outlet chamber 49 and the delivery manifold 7 can be substantially co-axial, i.e. axially aligned. The outlet chamber 49 can thus be directly connected to the delivery manifold 7, which connects the compressor delivery side with a piping. The outlet chamber 49 can thus form an extension of the delivery manifold 7. The flow of compressed gas can, therefore, be delivered directly from the outlet 430 of the return channel arrangement 43 into the piping. A volute, as commonly provided in current art compressors, is not required.

In other embodiments, including more than two impellers, the second return channel arrangement 43 could be in fluid communication with the inlet of a serially arranged third impeller. Further additional return channels and corresponding impellers can be serially arranged to form a multi-stage compressor with a large number of stages, not limited by any rotordynamic consideration as in current beam-compressors.

The inlet of the first impeller 11A is in fluid communication with an inlet chamber 20, where through gas entering the inlet manifold 5 flows and where from the gas enters the first impeller 11A. In some embodiments the inlet manifold 5 and the inlet chamber 20 can be substantially co-axial, i.e. axially aligned. The gas flow can thus enter directly from the piping into the first impeller. The inlet chamber 20 can form an extension of the inlet manifold 5.

The arrangement of the inlet manifold 5, inlet chamber 20, outlet chamber 49 and outlet manifold 7 allow the motor-compressor 1 to be mounted coaxially with the piping, since no driving shaft and motor external to the compressor are required.

Each impeller 11A, 11B of the motor-compressor 1 can be rotatingly supported in the casing 3 by means of suitable bearings. In some embodiments the first impeller 11A can be supported by one or more bearings 51A, 53A, which can be arranged between the impeller 11A and a stationary component 55 arranged in the casing 3. Bearings 51A and 53A may have an axial bearing function, i.e. they are provided for withstanding the axial thrust generated on the respective impeller 11A, while the latter is rotating and processes the gas flowing through the gas flow vanes 31A. The bearings 51A, 53A can comprise active magnetic bearings, roller bearings, or combinations thereof. In some embodiments the bearings 51A, 53A can also have a radial-bearing function, i.e. they can radially support the impeller. In other embodiments, the radial support can be provided by the motor stator 15A and the motor rotor 17A, which are arranged around the impeller 11A. In yet further embodiments, one or both bearings 51A, 53A can include auxiliary radial rolling bearings, which support the impeller when the magnetic bearing effect of the electric motor is not sufficient or absent.

In some embodiments the second impeller 11B can be rotatingly supported by respective bearings 51B and 53B arranged, for example, between the impeller 11B and the stationary diaphragm 37. Similarly to the bearings 51A and 53A, also bearings 51B and 53B can have an axial bearing function, thus supporting the axial thrust generated by the gas being processed through the impeller 11B. The bearings 51B, 53B can comprise active magnetic bearings, roller bearings, or combinations thereof. In some embodiments the bearings 51B, 53B can also have a radial-bearing function, i.e. they can radially support the impeller 11B. In other embodiments, the radial support can be provided by the motor stator 15B and the motor rotor 17B, which are arranged around the impeller 11B. In yet further embodiments, one or both bearings 51B, 53B can include auxiliary radial rolling bearings, which support the impeller 11B when the magnetic bearing effect of the electric motor is not sufficient or absent.

Figure 1:
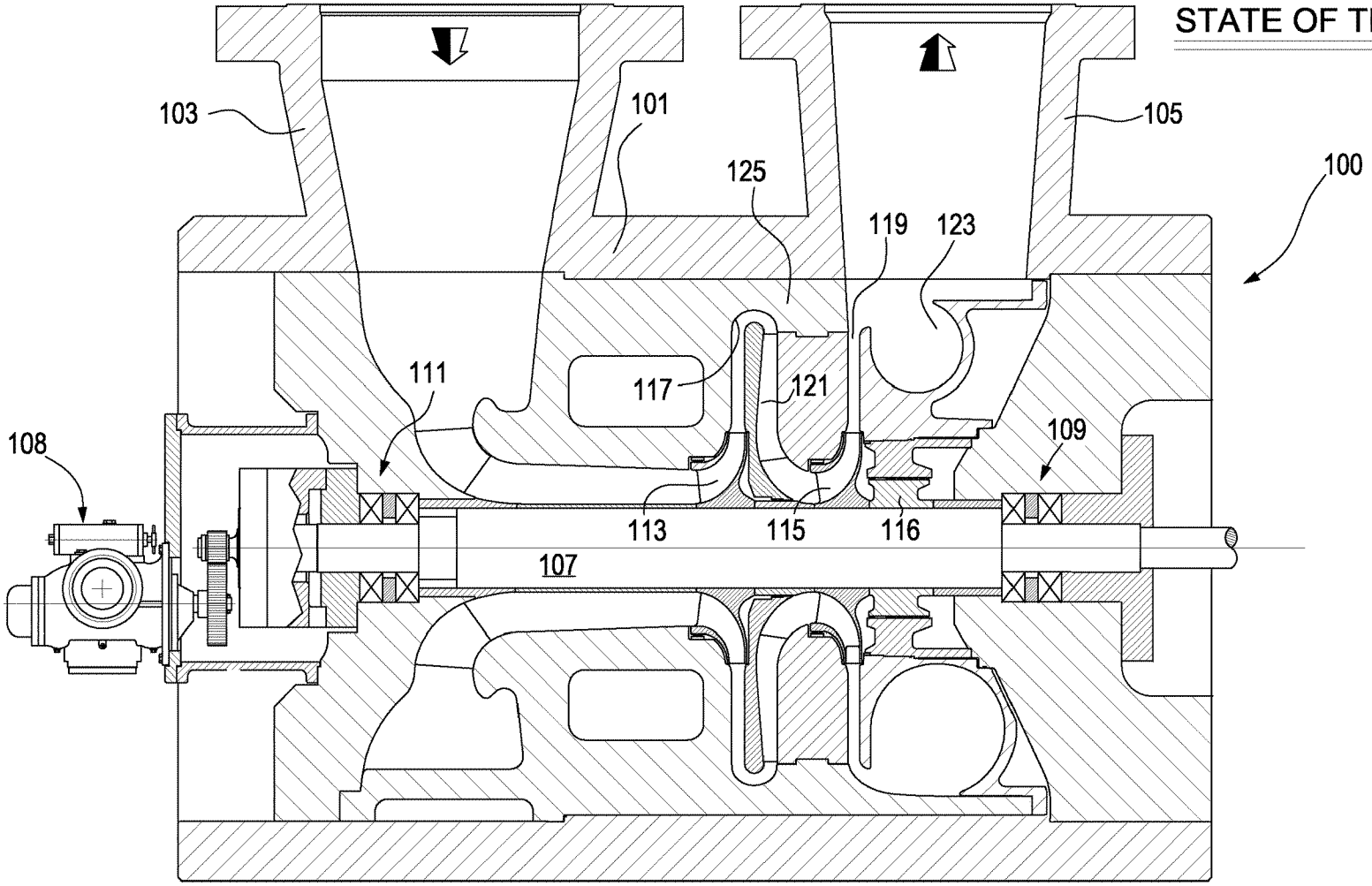
FIG. 1 illustrates a section along an axial plane of a multi-stage compressor of the current art.

With this arrangement, each impeller is axially supported by respective bearings, thus distributing the axial load on a plurality of bearings arrangements. A balancing drum can be dispensed with. Moreover, the impellers 11A and 11B are thus drivingly supported in casing 3 without the need for a central axial shaft and relevant bearings and sealing arrangements as in the current art compressors, for instance the one shown in FIG. 1.

Sealing arrangements can be provided between each impeller 11A, 11B and the stationary component supporting the impeller, namely the diaphragm 37 and the component 55, for example. In the schematic section of FIG. 3, a first sealing 57A is arranged between the stationary component 55 and the impeller 11A and a second sealing 57B is provided between the second impeller 11B and the diaphragm 37. The sealings 57A and 57B can be arranged around the inlet of the respective impeller and prevent or limit backflow of the compressed gas exiting the respective impeller towards the inlet of the same impeller, thus improving the efficiency of each compressor stage.

The impeller inlet, at the leading edges 29L of the blades 29A, 29B, and the impeller outlet, located at the radially outward end of the respective diffuser 33A, 33B, are distanced from one another by an extend which exceeds the distance usually provided for between the impeller outlet and the impeller inlet in a compressor of the current art. The larger distance between impeller inlet and impeller outlet is determined by the diffuser being an integral part of the rotating impeller. Conversely, in the current art compressors the diffuser forms part of the stationary components of the compressor, and the impeller outlet is thus arranged at the trailing edges of the impeller blades, upstream of the inlet of the outwardly arranged stationary diffuser.

Consequently, sealing between the impeller outlet and the impeller inlet is easier and less critical.

In further embodiments, not shown, additional seals arrangements can be provided in addition to or alternatively to the sealing arrangements 57A and 57B in different locations along the radial development of the respective rotary discs 35A, 35B, for example in a position radially outwardly the bearings 53A and 53B.

The integrated motor-compressor 1 described so far operates as follows. A flow F of gas to be processed enters the motor-compressor 1 through the inlet manifold 5, flows through the inlet chamber 20 and enters the first impeller 11A being sucked thereby.

The latter is rotated by the first embedded electric motor 13A, causing acceleration and compression of the gas through the flow vanes 31A and the diffuser 33A. The gas is then returned through the first return channel arrangement 39 from the outlet of the rotating diffuser 33A towards the inlet of the second impeller 11B.

Rotation of the second impeller 11B driven by the second embedded electric motor 13B causes the gas to flow through the vanes 31B and the second diffuser 33B, where through the gas is further accelerated and compressed and subsequently collected by the second return channel arrangement 43 and returned radially inwardly towards the outlet chamber 49.

The use of impellers provided with embedded motors 13A, 13B, removes the need for a compressor shaft supporting the impellers and relevant bearings and sealing arrangements on the rotor shaft, to prevent the escape of gas from the interior of the compressor to the environment.

By arranging the embedded electric motors 13A, 13B around the respective impellers and specifically so as to circumferentially surround the blades 29A and 29B results in a very compact mechanical arrangement.

Moreover, by providing diffusers 33A and 33B integrally rotating with the blades of the respective rotating impellers 11A, 11B a more stable flow through the compressor is achieved, extending the operability at the low-flow end of the operating range.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

The invention claimed is:

1. A motor-compressor comprising:

a casing;

at least one compressor stage arranged in the casing, the at least one compressor stage comprising:

an impeller arranged for rotation in the casing around a rotation axis and comprising a plurality of blades arranged around the rotation axis;

an embedded electric motor comprised of a motor stator and a motor rotor, wherein the motor stator circumferentially surrounds the impeller, and the motor rotor is integral with the impeller, and a diffuser arrangement positioned radially between the plurality of blades and the motor rotor; and a stationary component attached to the casing, wherein the stationary component is arranged upstream and downstream of the at least one compressor stage to support axially the at least one compressor stage.

2. The motor-compressor of claim 1, wherein the at least one compressor stage further comprising a plurality of compressor stages.

3. The motor-compressor of claim 2, wherein the impeller comprises the plurality of blades arranged around the rotation axis and forming vanes for a flow of process gas, the vanes extending from leading edges to trailing edges of the blades, and wherein the motor stator is arranged radially outwardly and at least partly around the blades of the respective impeller.

4. The motor-compressor of claim 1, wherein the plurality of blades arranged around the rotation axis form vanes for a flow of process gas, the vanes extending from leading edges to trailing edges of the blades, and wherein the motor stator is arranged radially outwardly and at least partly around the blades of the impeller.

5. The motor-compressor of claim 4, wherein the motor rotor of the impeller is located between the motor stator and the blades.

6. The motor-compressor of claim 5, wherein the impeller further comprises the diffuser arrangement surrounding the blades and rotating therewith.

7. The motor-compressor of claim 1, wherein the diffuser arrangement surrounds the blades and rotates therewith.

8. The motor-compressor of claim 1, wherein the at least one compressor stage comprises a rotary disc in which the blades and the diffuser arrangement are formed, the rotary disc having a circumferential region surrounding the blades and the diffuser arrangement and housing the motor rotor.

9. The motor-compressor of claim 8, wherein the motor stator surrounds the circumferential region of the rotary disc.

10. The motor-compressor of claim 9, wherein the blades and the diffuser arrangement are formed monolithically in the rotary disc.

11. The motor-compressor of claim 8, wherein the blades and the diffuser arrangement are formed monolithically in the rotary disc.

12. The motor-compressor of claim 11, wherein the rotary disc forms a hub and a shroud of the impeller.

13. The motor-compressor of claim 1, wherein the at least one compressor stage comprises an upstream compressor stage and a downstream compressor stage, wherein the stationary component includes a stationary diaphragm i-s-arranged between the upstream and downstream compressor stages, and wherein a return channel arrangement is provided in the stationary diaphragm, returning gas delivered at the outlet of an impeller of the upstream compressor stage towards an inlet of an impeller of the downstream compressor stage.

14. The motor-compressor of claim 1, wherein the impeller comprises at least one axial bearing arranged between opposing radial surfaces of the impeller and the stationary component.

15. The motor-compressor of claim 1, wherein the impeller is radially supported by the motor stator and the motor rotor.

16. The motor-compressor of claim 1, wherein the at least one compressor having no shaft is supported radially within the case by the embedded electric motor.

17. The motor-compressor of claim 1, wherein the stationary component disposed downstream of the at least one compressor stage includes a stationary diaphragm having a through-channel in fluid communication with the diffuser.

18. The motor-compressor of claim 1, wherein the stationary component comprises:

an upstream stationary diaphragm disposed upstream of the at least one compressor stage, the upstream stationary diaphragm having a through-channel in fluid communication with the inlet of the motor-compressor and the impeller; and a downstream stationary diaphragm disposed downstream of the at least one compressor stage, the downstream stationary diaphragm having a through-channel in fluid communication with diffuser and an outlet of the motor-compressor.

19. A shaftless motor-compressor comprising:

a casing; and at least one compressor stage arranged in the casing; the at least one compressor stage comprising:

an impeller arranged for rotation in the casing around a rotation axis without a shaft;

an embedded electric motor housed in the casing and comprised of a motor stator and a motor rotor;

wherein the motor stator circumferentially surrounds the impeller, and the motor rotor is integral with the impeller, the motor rotor of the at least one compressor stage being arranged inside the motor stator;

wherein the impeller comprises a plurality of blades arranged around the rotation axis and forming vanes for a flow of process gas, the vanes extending from leading edges to trailing edges of the blades, and wherein the motor stator is arranged radially outwardly and at least partly around the blades of the impeller;

wherein the impeller further comprises a diffuser arrangement surrounding the blades and rotating therewith; and wherein the diffuser arrangement is positioned radially between the blades and the motor rotor of the impeller; and wherein the at least one compressor having no shaft is supported radially within the case by the embedded electric motor.

* * * * *